US009895897B2

(12) United States Patent
Miravet Jimenez et al.

(10) Patent No.: US 9,895,897 B2
(45) Date of Patent: Feb. 20, 2018

(54) SELECTIVELY PROVIDE PRESSURE DIFFERENCES BETWEEN RESERVOIRS TO CAUSE PRINTING FLUID MOVEMENT

(71) Applicant: HEWLETT-PACKARD DEVELOPMENT COMPANY, L.P., Houston, TX (US)

(72) Inventors: Joan-Albert Miravet Jimenez, San Cugat del Valles (ES); Marina Ferran Farres, Barcelona (ES); Francesc Ros Cerro, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/915,076

(22) PCT Filed: Aug. 27, 2013

(86) PCT No.: PCT/US2013/056888
§ 371 (c)(1),
(2) Date: Feb. 26, 2016

(87) PCT Pub. No.: WO2015/030736
PCT Pub. Date: Mar. 5, 2015

(65) Prior Publication Data

US 2016/0207317 A1 Jul. 21, 2016

(51) Int. Cl.
*B41J 2/175* (2006.01)
*B41J 2/18* (2006.01)

(52) U.S. Cl.
CPC ..... *B41J 2/175* (2013.01); *B41J 2/17556* (2013.01); *B41J 2/17596* (2013.01); *B41J 2/18* (2013.01); *B41J 2202/12* (2013.01)

(58) Field of Classification Search
CPC .... B41J 2/17556; B41J 2/17596; B41J 2/175; B41J 2/18; B41J 2202/12
See application file for complete search history.

(56) References Cited

U.S. PATENT DOCUMENTS 4,380,770 A * 4/1983 Maruyama ..... B41J 2/16508 347/29
6,336,722 B1 1/2002 Wotton et al.
2012/0200619 A1 8/2012 Bibl

FOREIGN PATENT DOCUMENTS

EP 2093065 8/2009
EP 2628599 8/2013
(Continued)

OTHER PUBLICATIONS

International Search Authority. ISA/KR. International Search Report. dated May 7, 2014. Application No. PCT/US2013/056888.

*Primary Examiner* — Geoffrey Mruk
(74) *Attorney, Agent, or Firm* — HP Inc. Patent Department

(57) ABSTRACT

A printing apparatus, a printing system and a method are disclosed. The method of moving printing fluid within a printing apparatus includes selectively providing a first pressure difference between a first reservoir and a second reservoir by a differential pressure system to cause the printing fluid to move from the first reservoir through a printing fluid applicator to the second reservoir. The method also includes selectively providing a second pressure difference between the first reservoir and the second reservoir by the different pressure system to cause the printing fluid to move from the second reservoir through the printing fluid applicator to the first reservoir.

20 Claims, 6 Drawing Sheets

(56) References Cited

FOREIGN PATENT DOCUMENTS

| | | | | | |
|---|---|---|---|---|---|
| JP | 2012-086544 | * | 5/2012 | ..... | B41J 2/18 |
| KR | 20120041013 | | 4/2012 | | |

* cited by examiner

SELECTIVELY PROVIDE PRESSURE DIFFERENCES BETWEEN RESERVOIRS TO CAUSE PRINTING FLUID MOVEMENT

BACKGROUND

A printing apparatus may include a reservoir and a printing fluid applicator. The reservoir may supply printing fluid to the printing fluid applicator. The printing fluid applicator may apply the printing fluid to form images on a substrate.

BRIEF DESCRIPTION OF THE DRAWINGS

Non-limiting examples are described in the following description, read with reference to the figures attached hereto and do not limit the scope of the claims. Dimensions of components and features illustrated in the figures are chosen primarily for convenience and clarity of presentation and are not necessarily to scale. Referring to the attached figures:

DETAILED DESCRIPTION

A printing apparatus may include a reservoir and a printing fluid applicator. The reservoir may supply printing fluid to the printing fluid applicator. The printing fluid applicator may apply the printing fluid therein to form images on a substrate. Printing fluid such as ultraviolet curing ink, however, may need to possess acceptable properties to be successfully applied by the printing fluid applicator to the substrate. At times, however, such acceptable properties may not be attained when a temperature of the printing fluid falls below an acceptable temperature, for example, due to it being idle for an un desired amount of time. Consequently, the printing fluid may possess unsatisfactory properties and may not be satisfactorily applied to the substrate.

In examples, a printing apparatus includes a first reservoir, a second reservoir, an applicator receiving area, and a differential pressure system. The applicator receiving area may receive a printing fluid applicator placed in fluid communication with the first reservoir and the second reservoir. The differential pressure system may selectively provide a first pressure difference between the first reservoir and the second reservoir to cause printing fluid to move from the first reservoir, and through the printing fluid applicator to the second reservoir. The differential pressure system may include a switching manifold, and the differential pressure system may selectively provide a second pressure difference between the first reservoir and the second reservoir to cause the printing fluid to move from the second reservoir, and through the printing fluid applicator to the first reservoir.

For example, printing fluid in the printing fluid applicator may be directed to flow in a first direction in response to the first pressure difference and flow in a reverse direction (e.g., second direction) in response to the second pressure difference. The reversing of the direction of fluid flow of the printing fluid within the printing fluid applicator may be repeated. The switching manifold may direct at least one of a first amount of pressure and a second amount of pressure to each one of the first reservoir and the second reservoir to selectively establish one of the first pressure difference and the second pressure difference between the first reservoir and the second reservoir. Consequently, the application and changing of pressure differences between respective reservoirs moves printing fluid to assist in maintaining a target temperature and acceptable properties of the printing fluid within the printing fluid applicator. Consequently, the printing fluid may possess acceptable properties to be satisfactory applied by the printing fluid applicator to a substrate.

Figure 1:
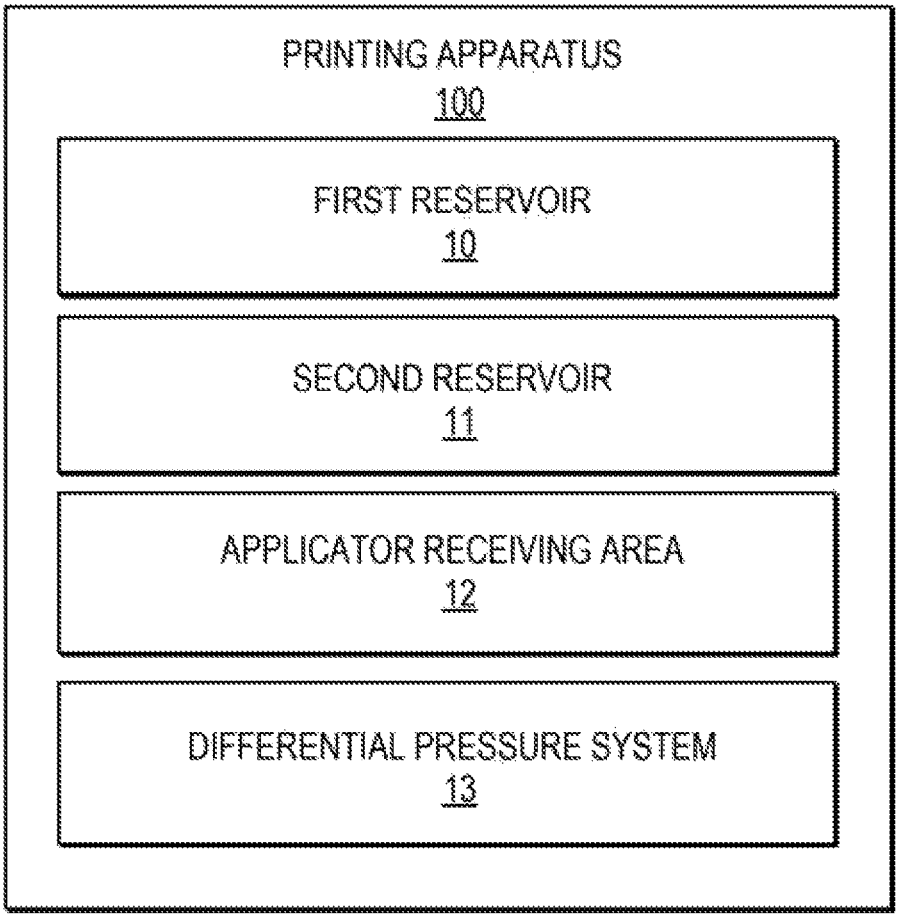
FIG. 1 is a block diagram illustrating a printing apparatus according to an example.

FIG. 1 is a block diagram illustrating a printing apparatus according to an example. Referring to FIG. 1, in some examples, a printing apparatus 100 may include a first reservoir 10, a second reservoir 11 an applicator receiving area 12, and a differential pressure system 13. The first reservoir 11) and the second reservoir 11 may provide printing fluid to the printing fluid applicator. The applicator receiving area 12 may receive a printing fluid applicator to be placed in fluid communication with the first reservoir 10 and the second reservoir 11. In some examples, the printing fluid applicator may be removably disposed in the applicator receiving area 12. Alternatively, the printing fluid applicator may be permanently disposed in the applicator receiving area 12.

Referring to FIG. 1, in some examples, the differential pressure system 13 may include a switching manifold 29. The differential pressure system 13 may selectively provide a first pressure difference between the first reservoir 10 and the second reservoir 11 to cause printing fluid to move from the first reservoir 10, and through the printing fluid applicator to the second reservoir 11. Additionally, the differential pressure system 13 may selectively provide a second pressure difference between the first reservoir 10 and the second reservoir 11 to cause the printing fluid to move from the second reservoir 11, and through the printing fluid applicator to the first reservoir 10. Accordingly, within the printing fluid applicator, printing fluid may move in a first direction from one end of the printing fluid applicator to another end of the printing fluid applicator in response to the first pressure difference.

Further, within the printing fluid applicator, printing fluid may move in a second direction from the other end to the one end in response to the second pressure difference. For example, the second direction may be opposite to the first direction. The switching manifold 29 may direct at least one of a first amount of pressure and a second amount of pressure to each one of the first reservoir 10 and the second reservoir 11 to selectively establish one of the first pressure difference and the second pressure difference between the first reservoir 10 and the second reservoir 11.

In some examples, the differential pressure system 13 may be implemented in hardware, software including firmware, or combinations thereof. The firmware, for example, may be stored in memory and executed by a suitable instruction-execution system. If implemented in hardware, as in an alternative example, the differential pressure system 13 may be implemented with any or a combination of technologies which are well known in the art (for example, discrete-logic circuits, application-specific integrated circuits (ASICs), programmable-gate arrays (PGAs), field-programmable gate arrays (FPGAs)), and/or other later developed technologies. In other examples, the differential pressure system 13 may be implemented in a combination of software and data executed and stored under the control of a computing device.

Figure 2A:
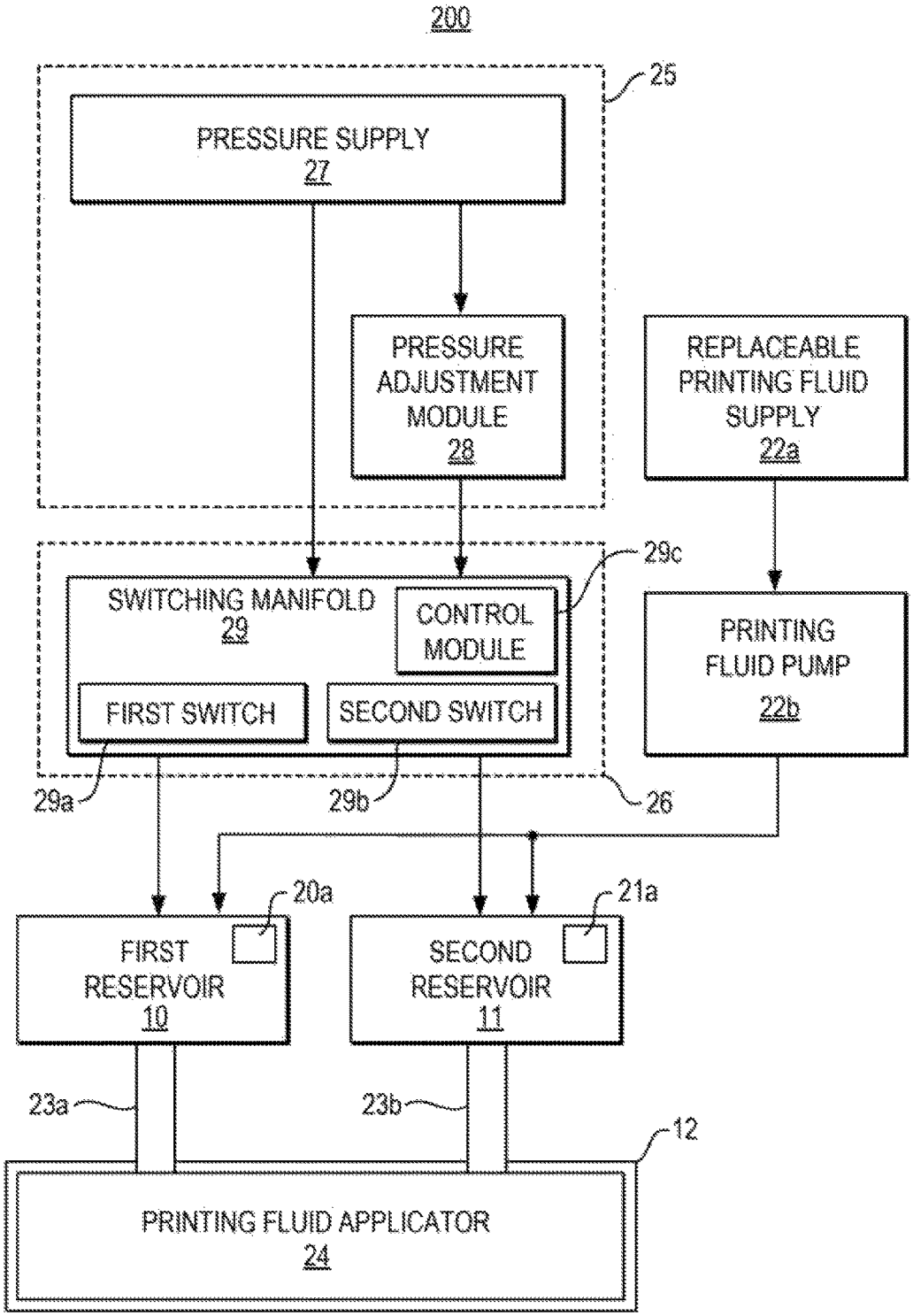
FIGS. 2A-2C are schematic views illustrating a printing apparatus according to examples.
Figure 2B:
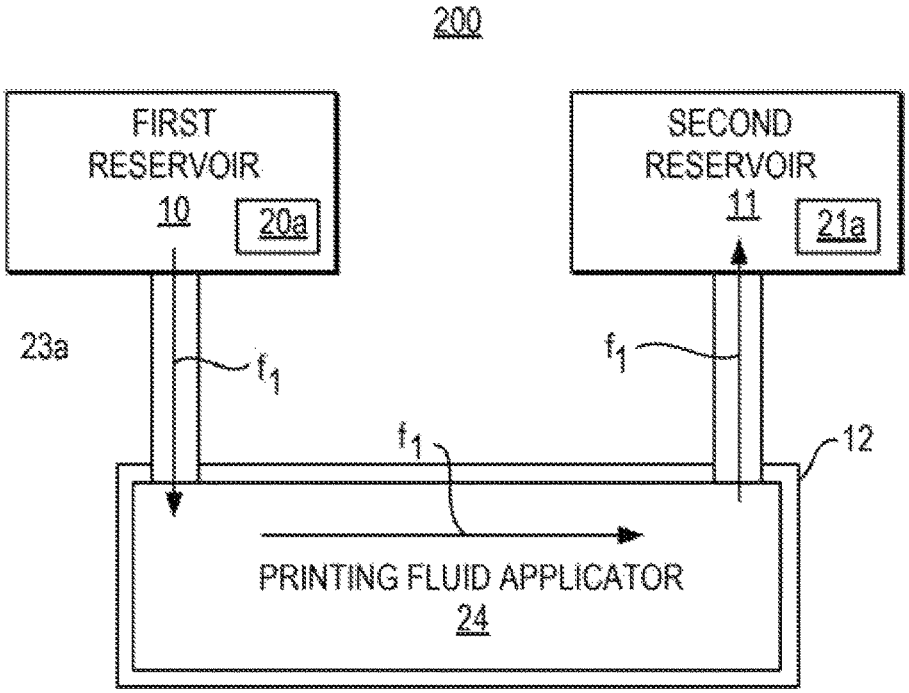
Figure 2C:
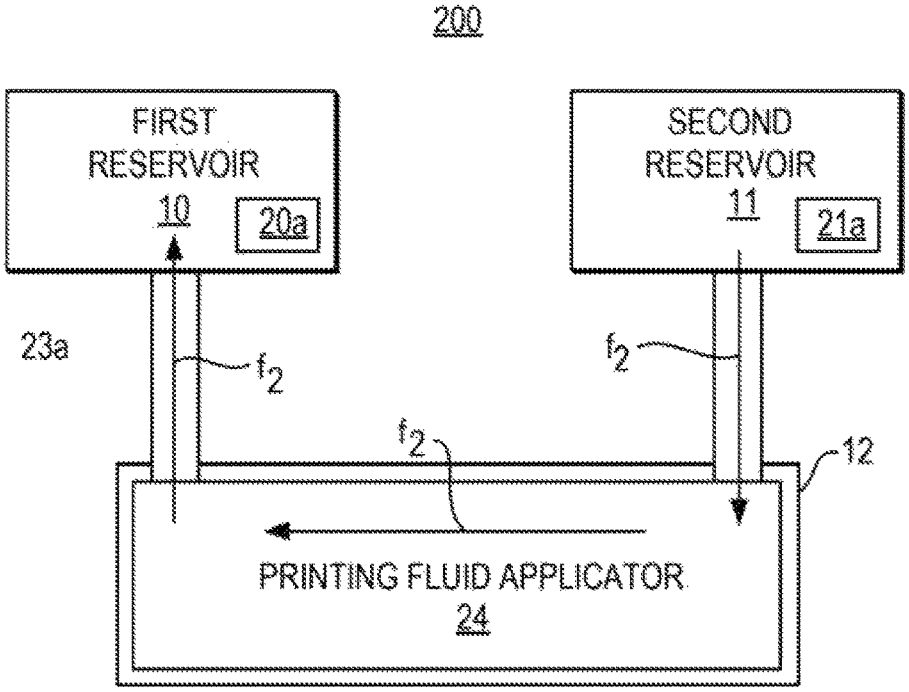

FIGS. 2A-2C are schematic views illustrating a printing apparatus according to examples. Referring to FIGS. 2A-2C, in some examples, the printing apparatus 200 may include the first reservoir 10, the second reservoir 11, the applicator receiving area 12, and the differential pressure system 13 previously discussed with respect to the printing apparatus 100 of FIG. 1. Referring to FIG. 2, in some examples, the differential pressure system 13 may also include an air movement device 25 and a control device 26. The air movement device 25 may provide a first amount of pressure and a second amount of pressure. In some examples, the air movement device 25 may include a pressure supply 27, and a pressure adjustment module 28. The pressure supply 27 may supply the first amount of pressure. The pressure adjustment module 28 may also communicate with the pressure supply 27 to supply the second amount of pressure. In some examples, the first amount of pressure and the second amount of pressure may be respective vacuum pressures. In some examples, the printing apparatus 200 may include at least one fluid parameter sensor (not illustrated) in communication with printing fluid to determine at least one of respective pressures and temperatures of the printing fluid and communicate such information to the control device 26.

Referring to FIGS. 2A-2C, in some examples, the control device 26 may selectively establish the first pressure difference and the second pressure difference between the first reservoir 10 and the second reservoir 11 at a predetermined interval. The predetermined interval may correspond to a period of time between the establishment of the first pressure difference and the second pressure difference. In some examples, the period of time may be about forty seconds. The control device 26 may control whether the first reservoir 10 and the second reservoir 11 receive the first amount of pressure and the second amount of pressure. In some examples, the control device 26 may include a switching module 29 including a first switch 29*a*, a second switch 29*b*, and a control module 29*c*.

Referring to FIGS. 2A-2C, in some examples, the switching manifold 29 may establish communication paths between the pressure supply 27 and the pressure adjustment module 28 with the first reservoir 10 and the second reservoir 11, respectively. For example, the first switch 29*a* may direct at least one of the first amount of pressure and the second amount of pressure to the first reservoir 10. For example, the second switch 29*b* may direct at least one of the first amount of pressure and the second amount of pressure to the second reservoir 11. The control module 29*c* may control the first switch 29*a* and the second switch 29*b* to selectively direct at least one of the first amount of pressure and the second amount of pressure to the first reservoir 10 and the second reservoir 11 and the respective timing thereof. Accordingly, the switching manifold 29 may selectively establish one of the first pressure difference and the second pressure difference between the first reservoir 10 and the second reservoir 11 at the predetermined interval. In some examples, the first pressure difference may be about eighty pascal (Pa). Accordingly, within the printing fluid applicator 24, printing fluid may move in a first direction $f_1$ from one end to another end in response to the first pressure difference. Further, within the printing fluid applicator 24, printing fluid may move in a second direction $f_2$ from the other end to the one end in response to the second pressure difference.

Referring to FIGS. 2A-2C, in some examples, the printing apparatus 200 may also include the printing fluid applicator 24 disposed in the applicator receiving area 12, and in fluid communication with the first reservoir 10 and the second reservoir 11. In some examples, the printing fluid applicator 24 may include a printhead, a plurality of printhead modules, a print bar, and/or a printhead assembly, and the like. For example, the printing fluid applicator 24 may include an inkjet printhead to eject printing fluid such as ultraviolet curing ink to form images on the substrate. The printing apparatus 200 may also include a first conduit 23*a*, a second conduit 23*b*, and at least one heating unit 20*a* and 21*a*, a replaceable printing fluid supply 22*a*, and a printing fluid pump 22*b*.

The first conduit 23*a* may place the first reservoir 10 in fluid communication with the printing fluid applicator 24 to move the printing fluid there between. The second conduit 23*b* may place the second reservoir 11 in fluid communication with the printing fluid applicator 24 to move the printing fluid there between. In some examples, in response to the first pressure difference, printing fluid flows in a first direction $f_1$ from the first reservoir 10, through the first conduit 23*a*, through the printing fluid applicator 24, through the second conduit 23*b*, and to the second reservoir 11 as illustrated in FIG. 2B. Alternatively, in response to the second pressure difference, printing fluid flows in a second direction $f_2$ from the second reservoir 11, through the second conduit 23*b*, through the printing fluid applicator 24, through the first conduit 23*a*, and to the first reservoir 10 as illustrated in FIG. 2C. For example, the second direction $f_2$ may be reversed from the first direction $f_1$.

The at least one heating unit 20*a* and 21*a* may heat the printing fluid in at least one of the first reservoir 10, the second reservoir 11, the first conduit 23*a*, and the second conduit 23*b*. At least one heating unit 20*a* and 21*a* may include a first heater 20*a* disposed in the first reservoir 10 and a second heater 21*a* disposed in the second reservoir 11. The first and second heater 20*a* and 21*a* may heat printing fluid to a target temperature to maintain the printing fluid in the printing fluid applicator 24 within a target temperature range. In some examples, the target temperature may be about fifty degrees Celsius and the target temperature range may be forty-nine to fifty-one degrees Celsius. The replaceable printing fluid supply 22*a* may supply the printing fluid. The printing fluid pump 22*b* may pump the printing fluid from the replaceable printing fluid supply 22*a* to at least one of the first reservoir 10 and the second reservoir 11.

Figure 3:
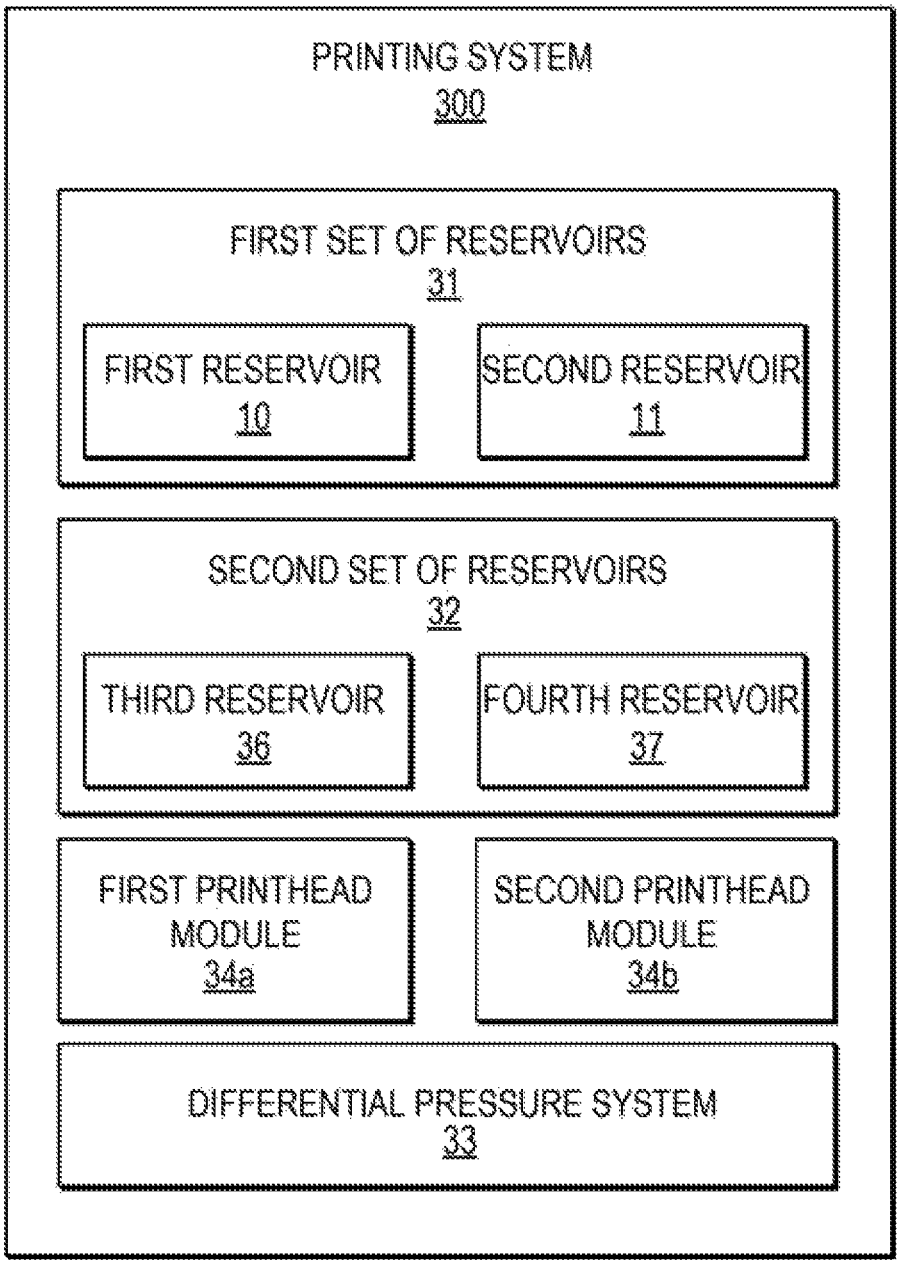
FIG. 3 is a block diagram illustrating a printing system according to an example.

FIG. 3 is a block diagram illustrating a printing system according to an example. Referring to FIG. 3, in some examples, a printing system 300 may include a first set of reservoirs 31 including a first reservoir 10 and a second reservoir 11, a second set of reservoirs 32 including a third reservoir 36 and a fourth reservoir 37, a first printhead module 34*a*, a second printhead module 34*b*, and a differential pressure system 33. The first printhead module 34*a* may be disposed between and in fluid communication with the first reservoir 10 and the second reservoir 11. The second printhead module 34*b* may be disposed between and in fluid communication with the third reservoir 36 and the fourth reservoir 37.

Referring to FIG. 3, in some examples, the differential pressure system 33 may selectively provide a first pressure difference between the first reservoir 10 and the second reservoir 11 to cause a first printing fluid to move from the first reservoir 10, and through the first printhead module 34*a* to the second reservoir 11. The differential pressure system 33 may also selectively provide a second pressure difference between the first reservoir 10 and the second reservoir 11 to cause the printing fluid to move from the second reservoir 11, and through the first printhead module 34*a* to the first reservoir 10. The differential pressure system 33 may also selectively provide the first pressure difference between the third reservoir 36 and the fourth reservoir 37 to cause a second printing fluid to move from the third reservoir 36, and through the second printhead module 34*b* to the fourth reservoir 37. The differential pressure system 33 may also selectively provide the second pressure difference between the third reservoir 36 and the fourth reservoir 37 to cause the second printing fluid to move from the fourth reservoir 37, and through the second printhead module 34*b* to the third reservoir 36.

Figure 4:
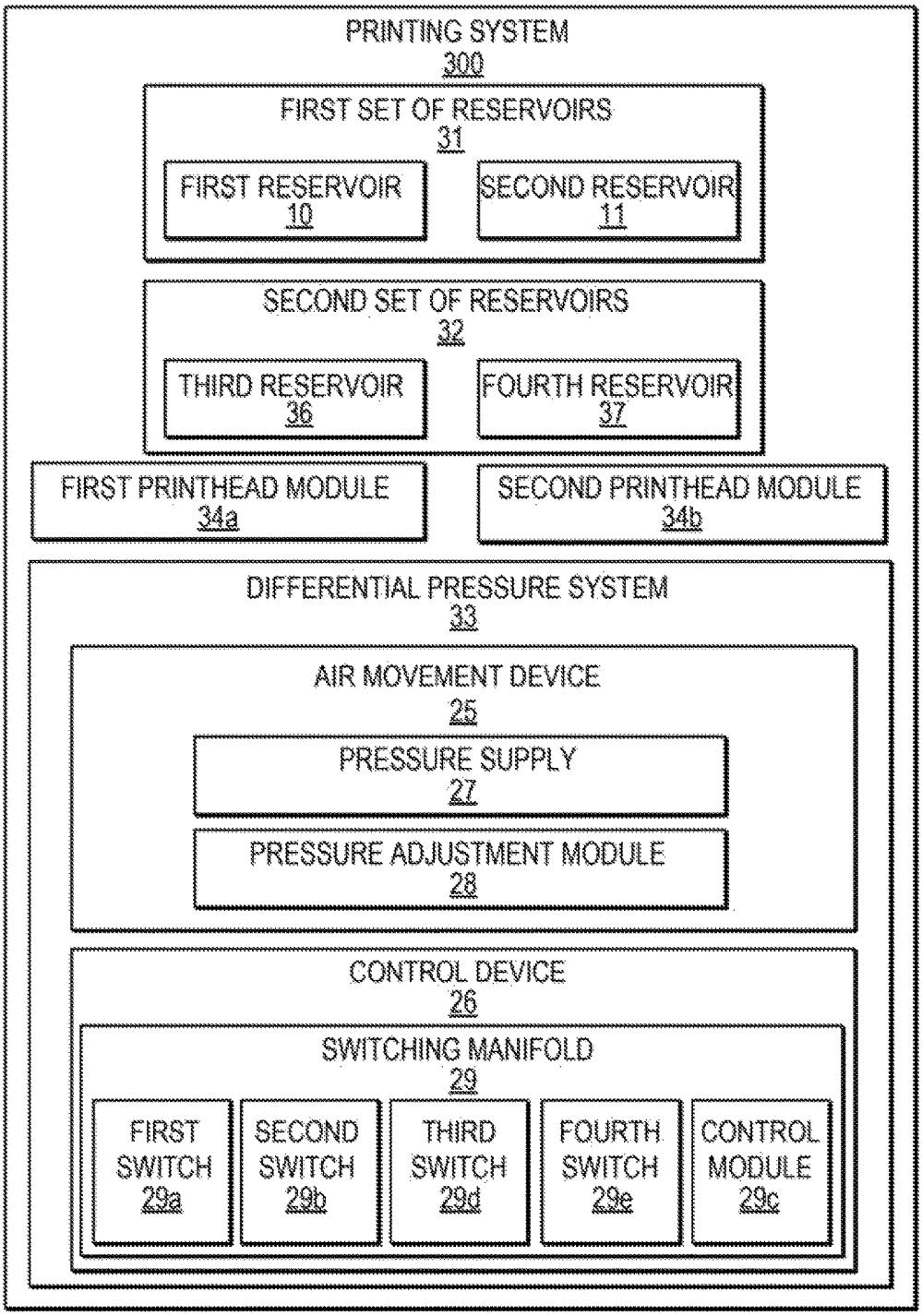
FIG. 4 is a block diagram illustrating the printing system of FIG. 3 according to an example.

FIG. 4 is a block diagram illustrating the printing system of FIG. 3 according to an example. Referring to FIG. 4, in some examples, the differential pressure system 33 may include the air movement device 25 and the control device 25 as previously discussed with respect to the printing apparatus 200 of FIG. 2. Referring to FIG. 4, in some examples, the air movement device 26 may provide a first amount of pressure and a second amount of pressure. In some examples, the air movement device 25 may include the pressure supply 27 and the pressure adjustment module 28. The pressure supply 27 may supply the first amount of pressure. The pressure adjustment module 28 may communicate with the pressure supply 27 to supply the second amount of pressure.

Referring to FIG. 4, in some examples, the control device 26 may selectively establish the first pressure difference end the second pressure difference between the first reservoir 10 and the second reservoir 11 at a predetermined interval. The predetermined interval may correspond to a period of time between the establishment of the first pressure difference and the second pressure difference. The control device 26 may control whether the first reservoir 10 and the second reservoir 11 receive the first amount of pressure and the second amount of pressure. In some examples, the control device 25 may include a switching module 29 including a first switch 29*a*, a second switch 29*b*, a third switch 29*d*, a fourth switch 29*e*, and a control module 29*c*. In some examples, the printing system 300 may include at least one fluid parameter sensor (not illustrated) in communication with printing fluid to determine at least one of respective pressures and temperatures of the printing fluid and communicate such information to the control device 26.

Referring to FIG. 4, in some examples, the switching manifold 29 may establish communication paths between the pressure supply 27 and the pressure adjustment module 28 with the first reservoir 10, the second reservoir 11, the third reservoir 36, and the fourth reservoir 37, respectively. For example, the first switch 29*a* may direct at least one of the first amount of pressure and the second amount of pressure to the first reservoir 10. The second switch 29*b* may direct at least one of the first amount of pressure and the second amount of pressure to the second reservoir 11. The third switch 29*d* may direct at least one of the first amount of pressure and the second amount of pressure to the third reservoir 36. Additionally, the fourth switch 29*e* may direct at least one of the first amount of pressure and the second amount of pressure to the fourth reservoir 37.

The control module 29*c* may control the first switch 29*a* and the second switch 29*b* to selectively direct at least one of the first amount of pressure and the second amount of pressure to the first reservoir 10 and the second reservoir 11, respectively, and the respective timing thereof. The control module 29*c* may also control the third switch 29*d* and the fourth switch 29*e* to selectively direct at least one of the first amount of pressure and the second amount of pressure to the third reservoir 36 and the fourth reservoir 37, respectively, and the respective timing thereof. Accordingly, the switching manifold 29 may also selectively establish one of the first pressure difference and the second pressure difference between the first reservoir 10 and the second reservoir 11 at a predetermined interval. Additionally, the switching manifold 29 may also selectively establish one of the first pressure difference and the second pressure difference between the third reservoir 10 and the fourth reservoir 11 at the predetermined interval.

Referring to FIG. 4, in some examples, the control device 26 may selectively establish the first pressure difference and the second pressure difference between the first reservoir 10 and the second reservoir 11 at a first predetermined interval, for example, by controlling whether the first reservoir 10 and the second reservoir 11 receive the first amount of pressure and the second amount of pressure. The control device 26 may also selectively establish the first pressure difference and the second pressure difference between the third reservoir 36 and the fourth reservoir 37 at a second predetermined interval, for example, by controlling whether the third reservoir 36 and the fourth reservoir 37 receive the first amount of pressure and the second amount of pressure. A heater may be disposed in each one of the first, second, third and fourth reservoir 10, 11, 36, and 37 to heat printing fluid to a target temperature.

Figure 5:
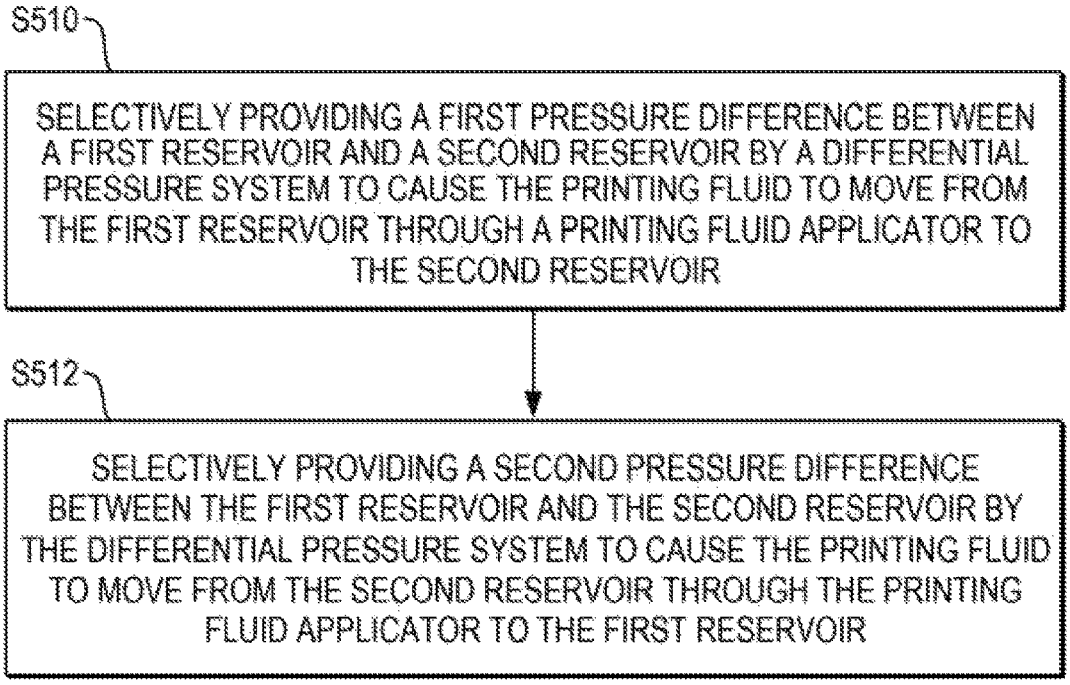
FIG. 5 is a flowchart illustrating a method of moving printing fluid within a printing apparatus according to an example.

FIG. 5 is a flowchart illustrating a method of moving printing fluid within a printing apparatus according to an example. In block S510, a first reservoir is placed in fluid communication with a printing fluid applicator of the printing apparatus by a first conduit to move the printing fluid there between. In block S512, a second reservoir is placed in fluid communication with the printing fluid applicator by a second conduit to move the printing fluid there between. In block S514, a first pressure difference between the first reservoir and the second reservoir is selectively provided by a differential pressure system to cause the printing fluid to move from the first reservoir through the printing fluid applicator to the second reservoir. For example, a first amount of pressure and a second amount of pressure may be provided by an air movement device of the differential pressure system. Additionally, whether the first reservoir and the second reservoir receive the first amount of pressure and the second amount of pressure are controlled by a control device of the differential pressure system. In block S516, a second pressure difference between the first reservoir and the second reservoir is selectively provided by the differential pressure system to cause the printing fluid to move from the second reservoir through the printing fluid applicator to the first reservoir.

In block S518, the printing fluid in at least one of the first reservoir, the second reservoir, the first conduit and the second conduit is heated by at least one heating unit. For example, the at least one heating unit may include a first heater disposed at the first reservoir and a second heater disposed at the second reservoir to maintain the printing fluid in the fluid applicator within a predetermined temperature range. In some examples, the method may also include establishing a predetermined interval by the control device to switch between the selectively providing the first pressure difference and the selectively providing the second pressure difference. Additionally, the method may also include selectively establishing the first pressure difference and the second pressure difference between the first reservoir and the second reservoir at the predetermined interval by the control device.

In some examples, providing the first amount of pressure and the second amount of pressure by the air movement may include supplying the first amount of pressure by a pressure supply of the air movement device and communicating with the pressure supply by a pressure adjustment module of the air movement device to supply the second amount of pressure. In some examples, controlling whether the first reservoir and the second reservoir receive the first amount of pressure and the second amount of pressure by the control device may also include establishing communication paths between each one of the pressure supply and the pressure adjustment module with the first reservoir and the second reservoir by a switching manifold of the air movement device, respectively.

Additionally, controlling whether the first reservoir and the second reservoir receive the first amount of pressure and the second amount of pressure by the control device may also include communicating with the switching manifold to direct at least one of the first amount of pressure and the second amount of pressure to each one of the first reservoir and the second reservoir by the control device to selectively establish one of the first pressure difference and the second pressure difference between the first reservoir and the second reservoir at a predetermined interval.

It is to be understood that the flowchart of FIG. 5 illustrates architecture, functionality, and/or operation of examples of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowchart of FIG. 5 illustrates a specific order of execution, the order of execution may differ from that which is depicted. For example, the order of execution of two or more blocks may be rearranged relative to the order illustrated. Also, two or more blocks illustrated in succession in FIG. 5 may be executed concurrently or with partial concurrence. All such variations are within the scope of the present disclosure.

The present disclosure has been described using non-limiting detailed descriptions of examples thereof that are not intended to limit the scope of the general inventive concept. It should be understood that features and/or operations described with respect to one example may be used with other examples and that not all examples have all of the features and/or operations illustrated in a particular figure or described with respect to one of the examples. Variations of examples described will occur to persons of the art. Furthermore, the terms "comprise," "include," "have" and their conjugates, shall mean, when used in the disclosure and/or claims, "including but not necessarily limited to."

It is noted that some of the above described examples may include structure, acts or details of structures and acts that may not be essential to the general inventive concept and which are described for illustrative purposes. Structure and acts described herein are replaceable by equivalents, which perform the same function, even if the structure or acts are different, as known in the art. Therefore, the scope of the general inventive concept is limited only by the elements and limitations as used in the claims.

What is claimed is:

1. A printing apparatus, comprising:

a first reservoir;

a second reservoir;

an applicator receiving area to receive a printing fluid applicator to be placed in fluid communication with the first reservoir and the second reservoir; and a differential pressure system including a switching manifold to selectively provide a first pressure difference between the first reservoir and the second reservoir to cause printing fluid to move from the first reservoir through the printing fluid applicator to the second reservoir, and to selectively provide a second pressure difference between the first reservoir and the second reservoir to cause the printing fluid to move from the second reservoir through the printing fluid applicator to the first reservoir; and wherein the switching manifold is configured to direct at least one of a first amount of pressure and a second amount of pressure to each one of the first reservoir and the second reservoir to selectively establish one of the first pressure difference and the second pressure difference between the first reservoir and the second reservoir; and a control device for the differential pressure system to operate the differential pressure system to repeatedly apply the first and then the second pressure differences at a predetermined interval to move the printing fluid back and forth repeatedly between the first and second reservoirs to assist in maintaining a target temperature of the printing fluid.

2. A method of operating the printing system of claim 1, the method comprising:

placing the first reservoir in fluid communication with the printing fluid applicator of the printing apparatus by a first conduit to move the printing fluid there between;

placing the second reservoir in fluid communication with the printing fluid applicator by a second conduit to move the printing fluid there between;

selectively providing a first pressure difference between the first reservoir and the second reservoir by the differential pressure system to cause the printing fluid to move from the first reservoir through the printing fluid applicator to the second reservoir;

selectively providing a second pressure difference between the first reservoir and the second reservoir by the differential pressure system to cause the printing fluid to move from the second reservoir through the printing fluid applicator to the first reservoir; and heating the printing fluid in at least one of the first reservoir; the second reservoir, the first conduit and the second conduit by at least one heating unit.

3. The method of claim 2, wherein the selectively providing a first pressure difference and the selectively providing a second pressure difference further comprise:

providing a first amount of pressure and a second amount of pressure by an air movement device of the differential pressure system; and controlling whether the first reservoir and the second reservoir receive the first amount of pressure and the second amount of pressure by a control device of the differential pressure system.

4. The method of claim 3, further comprising:

establishing a predetermined interval by the control device to switch between the selectively providing the first pressure difference and the selectively providing the second pressure difference; and selectively establishing the first pressure difference and the second pressure difference between the first reservoir and the second reservoir at the predetermined interval by the control device.

5. The method of claim 3, wherein the providing a first amount of pressure and a second amount of pressure by an air movement device of the differential pressure system further comprises:

supplying the first amount of pressure by a pressure supply of the air movement device; and communicating with the pressure supply by a pressure adjustment module of the air movement device to supply the second amount of pressure.

6. The method of claim 5, wherein the controlling whether the first reservoir and the second reservoir receive the first amount of pressure and the second amount of pressure by a control device of the differential pressure system further comprises:

establishing communication paths between each one of the pressure supply and the pressure adjustment module with the first reservoir and the second reservoir by a switching manifold, respectively, to direct at least one of the first amount of pressure and the second amount of pressure to each one of the first reservoir and the second reservoir to selectively establish one of the first pressure difference and the second pressure difference between the first reservoir and the second reservoir at a predetermined interval.

7. The method of claim 2, wherein the heating the printing fluid in at least one of the first reservoir, the second reservoir, the first conduit and the second conduit by at least one heating unit comprises: a first heater disposed at the first reservoir and a second heater disposed at the second reservoir to maintain the printing fluid in the fluid applicator within a predetermined temperature range.

8. The printing apparatus of claim 1, wherein the differential pressure system further comprises:

an air movement device to provide the first amount of pressure and the second amount of pressure.

9. The printing apparatus of claim 8, wherein the air movement device comprises:

a pressure supply to supply the first amount of pressure; and a pressure adjustment module to communicate with the pressure supply to supply the second amount of pressure.

10. The printing apparatus of claim 8, further comprising:

the printing fluid applicator disposed in the applicator receiving area, and in fluid communication with the first reservoir and the second reservoir;

a replaceable printing fluid supply to supply the printing fluid; and a printing fluid pump to pump the printing fluid from the replaceable printing fluid supply to at least one of the first reservoir and the second reservoir.

11. The printing apparatus of claim 1, further comprising:

a first conduit to place the first reservoir in fluid communication with the printing fluid applicator to move the printing fluid there between;

a second conduit to place the second reservoir in fluid communication with the printing fluid applicator to move the printing fluid there between; and at least one heating unit to heat the printing fluid in at least one of the first reservoir, the second reservoir, the first conduit, and the second conduit.

12. The printing apparatus of claim 1, wherein the printing fluid comprises ultraviolet curable ink and the printing fluid applicator comprises an inkjet print bar to selectively apply the printing fluid to a substrate.

13. The printing apparatus of claim 1, wherein:

the first reservoir comprises a first set of two reservoirs, and the second reservoir comprises a second set of two reservoirs;

the printing fluid applicator comprises a first printhead module disposed between and in fluid communication with the two reservoirs of first set of reservoirs;

the printing fluid applicator comprises a second printhead module disposed between and in fluid communication with the two reservoirs of second set of reservoirs; and the differential pressure system is to:

selectively provide a first pressure difference between the two reservoirs of first set of reservoirs to cause a first printing fluid to move from the first reservoir through the first printhead module to the second reservoir, selectively provide a second pressure difference between the two reservoirs of first set of reservoirs to cause the printing fluid to move from the second reservoir through the first printhead module to the first reservoir.

14. The printing apparatus of claim 13, wherein the differential pressure system is further to:

provide the first the first pressure difference between the two reservoirs of the second set of reservoirs to cause a second printing fluid to move between the two reservoirs of the second set of reservoirs by moving through the second printhead module; and provide the second pressure difference between the two reservoirs of the second set of reservoirs to cause the second printing fluid to move between the two reservoirs of the second set of reservoirs by moving through the second printhead module.

15. The printing device of claim 13, wherein the differential pressure system further comprises:

an air movement device to provide a first amount of pressure and a second amount of pressure; and a control device for the air movement device to selectively establish the first pressure difference and the second pressure difference between the two reservoirs of the first set of reservoirs at a predetermined interval, and to selectively establish the first pressure difference and the second pressure difference between the two reservoirs of the second set of reservoirs a predetermined interval.

16. The printing apparatus of claim 1, wherein the predetermined interval is 40 seconds.

17. The printing apparatus of claim 1, further comprising a fluid parameter sensor to determine pressure or temperature of the printing fluid, the fluid parameter sensor having an output to the control device.

18. A printing system, comprising:

a first set of reservoirs including a first reservoir and a second reservoir;

a second set of reservoirs including a third reservoir and a fourth reservoir;

a first printhead module disposed between and in fluid communication with the first reservoir and the second reservoir;

a second printhead module disposed between and in fluid communication with the third reservoir and the fourth reservoir; and a differential pressure system to selectively provide a first pressure difference between the first reservoir and the second reservoir to cause a first printing fluid to move from the first reservoir through the first printhead module to the second reservoir, to selectively provide a second pressure difference between the first reservoir and the second reservoir to cause the printing fluid to move from the second reservoir through the first printhead module to the first reservoir, to selectively provide the first pressure difference between the third reservoir and the fourth reservoir to cause a second printing fluid to move from the third reservoir through the second printhead module to the fourth reservoir, and to selectively provide the second pressure difference between the third reservoir and the fourth reservoir to cause the second printing fluid to move from the fourth reservoir through the second printhead module to the third reservoir.

19. The printing system of claim 18, wherein the differential pressure system further comprises:

an air movement device to provide a first amount of pressure and a second amount of pressure; and a control device to selectively establish the first pressure difference and the second pressure difference between the first reservoir and the second reservoir at a predetermined interval by controlling whether the first reservoir and the second reservoir receive the first amount of pressure and the second amount of pressure, and to selectively establish the first pressure difference and the second pressure difference between the third reservoir and the fourth reservoir at the predetermined interval by controlling whether the third reservoir and the fourth reservoir receive the first amount of pressure and the second amount of pressure.

20. The printing system of claim 19, wherein the air movement device comprises:

a pressure supply to supply the first amount of pressure; and a pressure adjustment module to communicate with the pressure supply to supply the second amount of pressure.

* * * * *